US012644627B2

(12) United States Patent
Lee et al.

(10) Patent No.: US 12,644,627 B2
(45) Date of Patent: Jun. 2, 2026

(54) CAPPING APPARATUS AND METHOD FOR IN-GROUND HEAT EXCHANGERS

(71) Applicant: INNOVIA GEO CORP., Oakville (CA)

(72) Inventors: Andrew Cameron Lee, Oakville (CA); Sarah Ruth Nicholson, Vancouver (CA)

(73) Assignee: INNOVIA GEO CORP., Oakville (CA)

( * ) Notice: Subject to any disclaimer, the term of this patent is extended or adjusted under 35 U.S.C. 154(b) by 0 days.

(21) Appl. No.: 18/864,961

(22) PCT Filed: May 31, 2023

(86) PCT No.: PCT/IB2023/055583

§ 371 (c)(1),
(2) Date: Nov. 12, 2024

(87) PCT Pub. No.: WO2023/233324

PCT Pub. Date: Dec. 7, 2023

(65) Prior Publication Data

US 2025/0109890 A1 Apr. 3, 2025

Related U.S. Application Data

(60) Provisional application No. 63/348,091, filed on Jun. 2, 2022.

(51) Int. Cl.
*F24T 10/13* (2018.01)
*E02D 5/28* (2006.01)
(Continued)

(52) U.S. Cl.
CPC ..... *F24T 10/13* (2018.05); *E02D 5/285* (2013.01); *F24T 50/00* (2018.05);
(Continued)

(58) Field of Classification Search
CPC . F24T 10/10; F24T 10/13; F24T 10/17; F24T 2010/56; F24T 50/00; F24T 2010/50
(Continued)

(56) References Cited

U.S. PATENT DOCUMENTS 4,325,228 A * 4/1982 Wolf ..... F25B 30/06 165/142
4,693,301 A * 9/1987 Baehrle ..... E01C 11/26 165/274

(Continued)

FOREIGN PATENT DOCUMENTS

CA 3121345 A1 8/2021
CN 110848855 A * 2/2020 ..... F24T 10/40

(Continued)

*Primary Examiner* — Jianying C Atkisson
*Assistant Examiner* — For K Ling
(74) *Attorney, Agent, or Firm* — Perry + Currier Inc.

(57) ABSTRACT

A system and method for in ground heat exchange, including at least one first array and one second array, each first and second array comprising a plurality of capped pipes; at least one temperature sensor; and at least one flow rate sensor, a plurality of flow rate valves connected to each first array and second array, the flow rate valves configured to facilitate flow of a liquid through the system; at least one pump attached to the flow rate valves for modulating the flow rate of the system; and a heat pump, wherein the system is configured to provide heating and cooling to a building.

15 Claims, 12 Drawing Sheets

(51) Int. Cl.
*F24T 10/00* (2018.01)
*F24T 50/00* (2018.01)
*F24D 3/18* (2006.01)

(52) U.S. Cl.
CPC ..... *E02D 2300/0029* (2013.01); *F24D 3/18* (2013.01); *F24D 2200/11* (2013.01); *F24T 2010/56* (2018.05)

(58) Field of Classification Search
USPC ..... 165/45
See application file for complete search history.

(56) References Cited

U.S. PATENT DOCUMENTS 5,975,192 A * 11/1999 Moratalla ..... F28D 1/024 165/905
9,404,664 B2 * 8/2016 Jonsson ..... F24D 19/1021
2004/0206085 A1 * 10/2004 Koenig ..... F24T 10/30 60/641.1
2005/0006049 A1 * 1/2005 Ross ..... F28F 27/02 165/45
2010/0307734 A1 * 12/2010 Wildig ..... F28D 20/0052 165/45
2011/0114284 A1 * 5/2011 Siegenthaler ..... F28F 27/00 165/45
2011/0167819 A1 * 7/2011 Lakic ..... H02K 7/1823 60/641.2
2011/0220341 A1 * 9/2011 Kidwell ..... G01K 17/00 165/200
2011/0272117 A1 * 11/2011 Hamstra ..... F24T 10/10 165/185
2012/0318491 A1 * 12/2012 Melink ..... F28D 20/0052 165/200
2014/0110082 A1 * 4/2014 Suver ..... F24T 10/17 165/45
2015/0094989 A1 * 4/2015 Collet ..... F24T 10/10 702/188
2019/0186789 A1 * 6/2019 Ahn ..... F24T 10/15
2022/0397308 A1 * 12/2022 Cho ..... F24T 10/15

FOREIGN PATENT DOCUMENTS

JP 2006029623 A * 2/2006 ..... F24T 10/10
JP 2014025658 A 2/2014
KR 101948120 B1 * 2/2019 ..... F24T 10/17
WO WO-2019106235 A1 * 6/2019 ..... F24T 10/15

* cited by examiner

CAPPING APPARATUS AND METHOD FOR IN-GROUND HEAT EXCHANGERS

FIELD

The specification relates generally to in-ground heat exchangers, and more particularly to the use of tubular pipes with capped tips for use as in-ground heat exchangers.

BACKGROUND

Energy used for space and water heating accounts for the majority of energy demand in residential sectors, and further accounts for a high percentage of energy demand in commercial and institutional building sectors in most countries around the world. Countries with a high landmass and extreme cold weather conditions, such as Canada, for example, experience high energy demand.

There are two pathways in which energy can be transferred from in ground heating and cooling technologies to a building: a first pathway where the heat that is transferred with the ground through the surface of the pipe, and a second pathway where the heat energy that is stored within the working fluid. The working fluid has a specific heat capacity, which is the quantity of heat (J) absorbed per unit mass (kg) of the material when its temperature increases 1 K (or 1° C.) so energy is stored within the mass of the working fluid in the form of heat.

Conventional in-ground heating and cooling technologies employ a ground source heat pump with a borehole loop, typically installed to depths of between 60 meters to 260 meters, to exchange heat with the ground. Such conventional borehole loop systems contain a small amount of working fluid because they use small diameter plastic pipes between 1"-2" in diameter to transfer heat into a building through the surface of the pipes, such that the first pathway is predominant. Such systems are not widely implemented due to high initial costs, longer payback periods and lesser return on investment.

Due to the high amount of greenhouse gas (GHG) emissions associated with burning fossil fuels for energy, there is a need for space heating and cooling that produces less emissions, is convenient to install, energy efficient, cost-efficient, and overcomes at least some of the shortcomings of prior art in-ground heating and cooling technologies.

SUMMARY

The present disclosure relates to the use of tubular pipes with capped tips for in-ground heat exchange, designed to replace conventional borehole tubing technique. The tubular pipes set forth herein provide a renewable energy source that utilizes the ground as a heat source or heat sink to exchange heat to and from a conditioned space.

The tubular pipes with capped tips, whether constructed of steel or plastic, provide a much larger working fluid volume in comparison with conventional borehole loop systems because the working fluid fills the entire volume of the larger diameter pipe. As a result, heat is transferred in a material manner via the second pathway discussed above (i.e. the heat energy stored within the fluid).

As the in-ground heat exchange system of the described embodiments operates, the working fluid temperature either increases (i.e., in cooling mode the system moves heat from the building into the working fluid within the pipes) or decreases (i.e. in heating mode the system moves heat from the working fluid in the pipes into the building) relative to the ambient ground temperature. This energy is stored within the fluid if the rate of heat transfer exceeds the rate at which heat is being transferred through the surface of the pipe.

In accordance with an aspect, a system is provided for in ground heat exchange, the system comprising at least one first array and one second array, each first and second array comprising: a plurality of capped pipes; at least one temperature sensor; and at least one flow rate sensor; the system further comprising a plurality of flow rate valves connected to each first array and second array, the flow rate valves configured to facilitate flow of a liquid through the system; at least one pump attached to the flow rate valves for modulating the flow rate of the system; and a heat pump; wherein the system is configured to provide heating and cooling to a building.

According to another aspect a method for in ground heat exchange is provided, the method comprising: collecting temperature inputs through temperature sensors on a first array and a second array; calculating a temperature difference between the first array and the second array; determining whether a temperature difference threshold has been exceeded, and activating the second array upon the determination that the temperature difference threshold has been exceeded; and deactivating the second array upon determination that the temperature difference threshold is no longer exceeded.

BRIEF INTRODUCTION TO THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed invention and explain various principles and advantages of those embodiments.

Implementations are described with reference to the following figures, in which.

Figure 1:
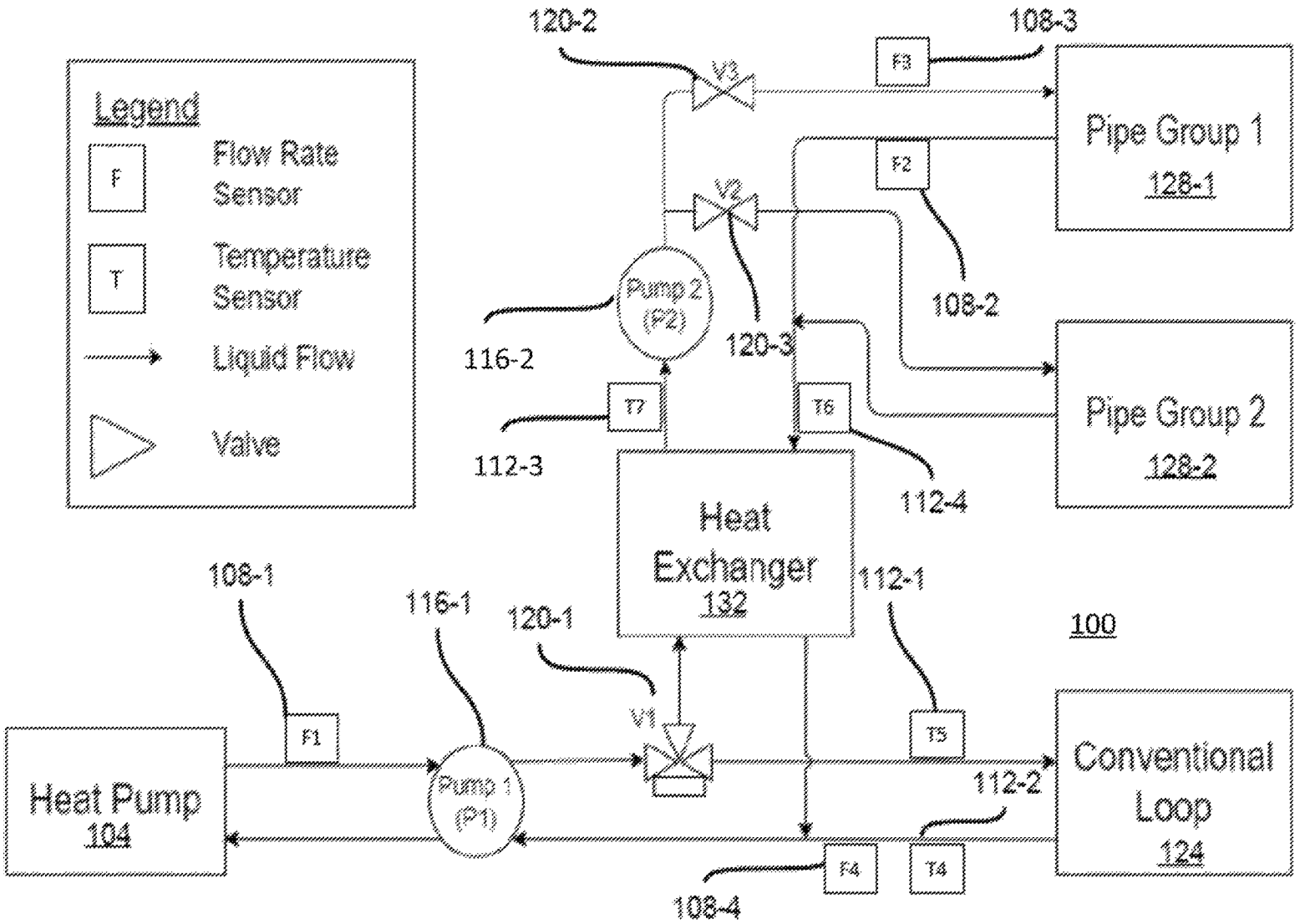
FIG. 1 shows a system for in-ground heat exchange using capped pipes, according to an embodiment.

Persons of skill in the art will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION

FIG. 1 depicts an example embodiment of a system 100 for in-ground heat exchange. The system 100 includes a heat pump 104. Heat pump 104 is used to heat or cool a space by exchanging heat from the space into system 100. Heat pump 104 may be any heat pump, such as a Versatec™ Variable Speed Heat Pump (as manufactured by WaterFurance Renewable Energy, Inc. with headquarters at 9000 conservation way, Fort Wayne, Indiana 46809, United States) or another heat pump that is apparent to those of skill in the art. The system also includes at least one flow rate sensor 108-1, 108-2 . . . **108-*n* (collectively, the flow rate sensors 108-1, 108-2 . . . 108-*n* will be referred to as flow rate sensors 108, and generically, as flow rate sensor 108. This nomenclature is used elsewhere herein). Further, system 100 comprises at least one temperature sensor 112-1, 112-2 . . . 112-*n* (collectively, the temperature sensors 112-1, 112-2 . . . 112-*n* will be referred to as temperature sensors 112, and generically, as temperature sensor 112. This nomenclature is used elsewhere herein). Each flow rate sensor 108 and temperature sensor 112 are connected along the various components of system 100, to measure and keep track of the flow rates and temperature throughout the system as is needed. The placement of the sensors 108 and 112 is done in a manner to be able to measure the flows and temperatures to calculate the energy (i.e., heat) transferred with each of three ground heat exchange systems: Pipe Group 1 128-1, Pipe Group 2 128-2, and Conventional Loop 124. The placement of the sensors 108 and 112** is done to measure the flow and temperature of the inlet and outlet of each of the ground heat exchange systems so as to measure the energy difference between the inlet an outlet flows to calculate the energy that is transferred by the ground heat exchange systems with a building.

System 100 additionally comprises of at least one pump 116-1, 116-2, to facilitate the flow of liquid throughout system 100. A first pump 116-1 is connected to heat pump 104. Pump 116-1, 116-2 is a variable speed pump which facilitates the flow of the liquid but also allows for the modulation of the flow rate. Adjusting the flow rate may provide a way to actively control the heat transfer through the system to match a heating or cooling load of a space.

System 100 further comprises at least one valve 120-1, 120-2, 120-3, collectively valve 120. Pump 116-1 is connected to a first valve 120-1. Valve 120 may be a 2- or 3-way electronically activated valve, as is needed. In the present embodiment, valve 120-1 is a 3-way electronically activated valve that is used to direct the flow between the conventional loop 124 and the pipe arrays 128. In the present embodiment, conventional loop 124 is a conventional borehole ground loop. It will be apparent to those skilled in the art that further embodiments of system 100 may not include conventional loop 124. Conventional loop 124 may be included in system 100 in embodiments in which the conventional loop 124 already exists as a source of in-ground heating, wherein conventional loop 124 works with pipe arrays 128 to provide in-ground heating and/or cooling. However, conventional loop 124 is not an integral component of system 100 and may be excluded as necessary. Additionally, conventional loop 124 may also be substituted with another HVAC system to function with the pipe arrays 128 in a hybrid manner. Pipe arrays 128 are controlled by 2-way electronically operated values 120-2 and 120-3 and operate on a fluid loop. System 100 further includes heat exchanger 132, which works to transfer heat from pipe arrays 128 to conventional loop 124. In the present embodiment, pipe arrays 128 comprise eight tubular pipes 136 outfitted with capped tips 140, (as shown in FIG. 2) each at a diameter of about 5.5 inches.

Tubular pipes 136 may be constructed of steel or plastic. Steel may be utilized in instances where a structure utilizes structural steel foundation piles to enable their simultaneous use as an in-ground heat exchanger and structural foundation element. Where a structure does not utilize structural steel piles, the tubular pipes may be constructed of plastic and integrated into other structural foundation elements, provided space is available to do so. Both tubular steel and plastic pipes may also be directly installed into the ground and utilized solely as an in-ground heat exchanger not integrated into structural foundation elements, as discussed below with reference to FIG. 10C.

Figure 2:
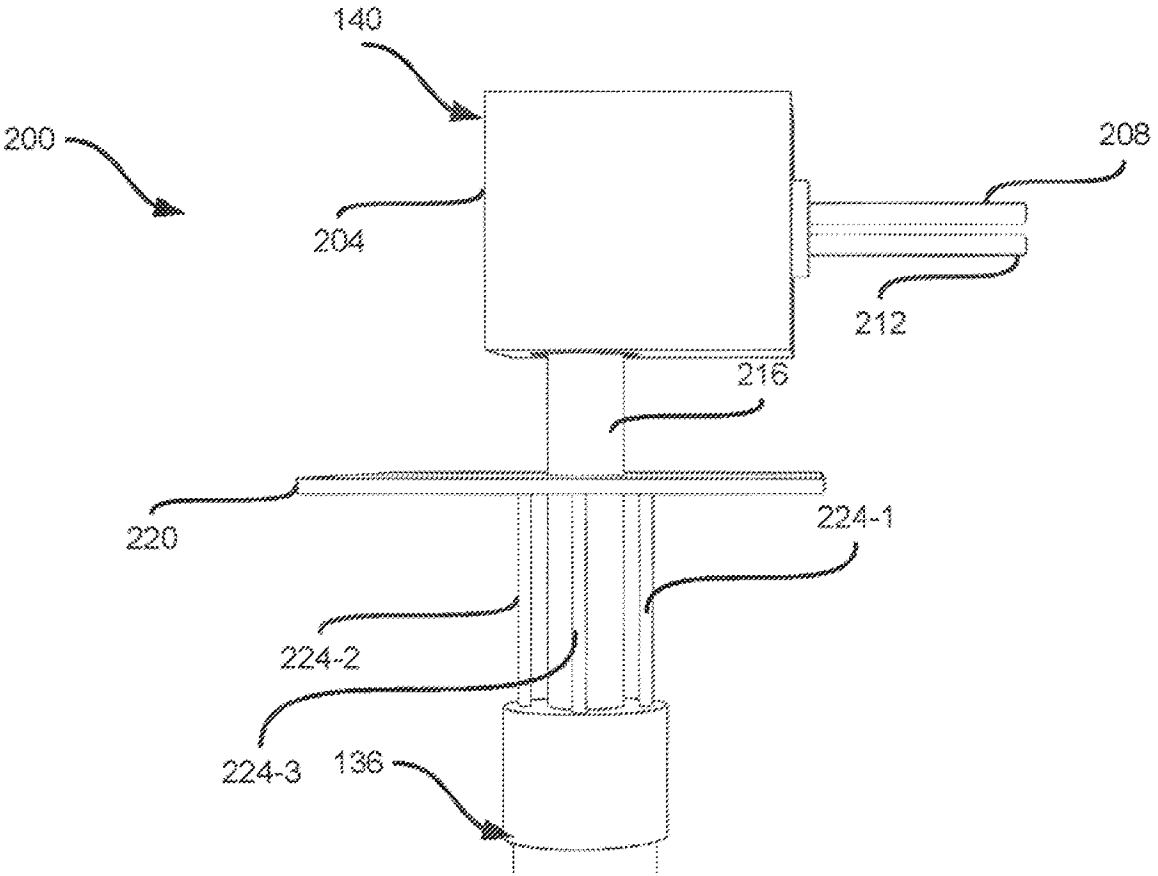
FIG. 2 shows a partial side view of an embodiment of a capped pipe.

Referring to FIG. 2, a partial side view of an example embodiment of tubular pipe 136 with a capped tip 140 is shown. Tubular pipe 136 combined with capped tip 140 will herein be referred to as capped pipe 200. In a present embodiment, each capped pipe 200 is spaced about 4.25 meters apart to mitigate thermal interference between pipe arrays 128 and conventional loop 124, although these measurements are non-limiting and depending on the amount of space system 100 is being installed in, the measurements may vary based on the type and geometry of the structural foundation elements being utilized, the heating and cooling load to be serviced, and the physical properties of the soil and climate where a system is installed. Capped pipe 200 comprises a maintenance enclosure 204. Maintenance enclosure 204 comprises an access portal (shown in FIG. 3) that provides access to maintenance components, such as a cleanout, or other maintenance components that will be apparent to those skilled in the art. Maintenance enclosure 204 further serves as protection surrounding inlet pipe 208 (also referred to herein as inlet 208) and outlet pipe 212 (also referred to herein as outlet 212). Pipe enclosure 216 is connected to maintenance enclosure 204, and inlet 208 and outlet 212 are further housed within pipe enclosure 216 for added protection. Pipe enclosure 216 may be a polyvinyl chloride (PVC) pipe, or any other plastic pipe as is apparent to those skilled in the art that will provide adequate housing and protection of inlet 208 and outlet 212. Pipe enclosure 216 fits through plate 220. In the case of structural tubular steel piles, plate 220 allows rebar and poured concrete that comprise a structure's floor slab to transmit the structural load down to pipe 136. As such, plate 220 enables pipe 136 to be a structural load bearing pile. Plate 220 can be made of steel, or any material that will allow load bearing, as will be apparent to those skilled in the art. Plate 220 is welded to at least one rod 224-1, 224-2 . . . **224-*n*, collectively rod 224, that allows the transfer of the structural load from plate 220 to pipe 136. In the cases of tubular plastic pipes embedded within structural foundation elements and tubular steel or tubular plastic pipes installed directly into the ground solely as in-ground heat exchangers, plate 220 and rod 224 may be omitted because the tubular pipes do not provide structural support. In operation, inlet 208 and outlet 212 are configured to circulate fluid within the interior of capped pipe 200 for in-ground heat transfer. It will be apparent to those skilled in the art that the fluid circulating within capped pipe 200 may be any heat carrier fluid, such as water or antifreeze (ethanol- or propylene glycol-based are typically used for ground heat exchange applications), that can be used by a heat pump 104. Inlet 208 extends downward to the bottom of pipe 136 (e.g. to about one foot above the bottom of pipe 136) and is configured to bring in fluid from heat pump 104 to the bottom of the column of fluid within pipe 136. The working fluid then circulates within pipe 200 and exchanges heat with the ground. Outlet 212 at the top of capped pipe 200 supplies fluid back to heat pump 104 forming a closed loop system. It will be apparent to those skilled in the art that for heating operation of heat pump 104, the fluid entering pipe 200 through inlet 208 will be colder than the fluid being supplied to heat pump 104 through outlet 212 with heat being transferred from the ground into the working fluid. For cooling operation of heat pump 104, the fluid entering pipe 200 through inlet 208 will be warmer than the fluid being supplied by heat pump 104 through outlet 212** with heat being transferred from the working fluid into the ground.

Figure 3:
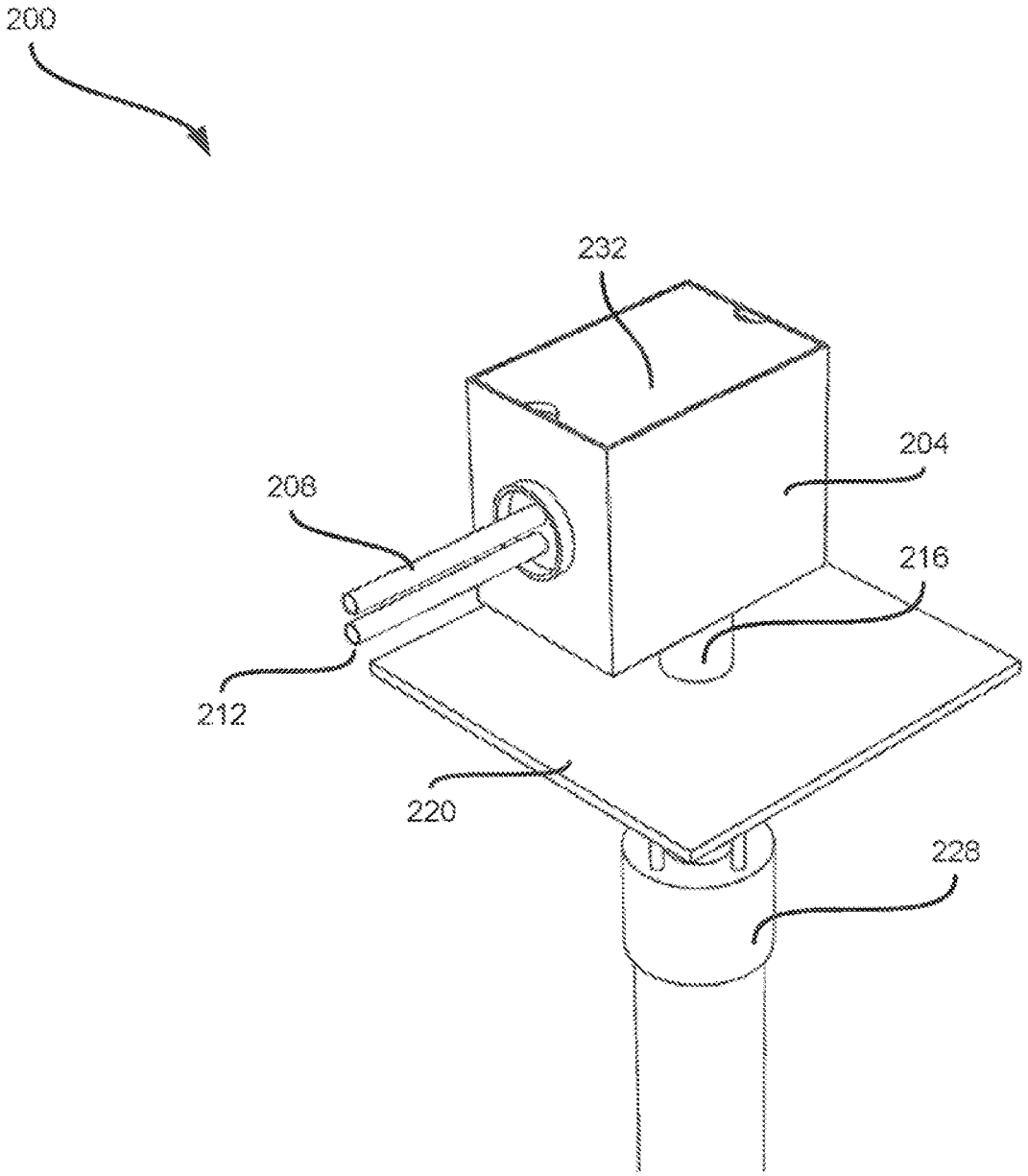
FIG. 3 shows a top isometric view of the capped pipe in FIG. 2.

Referring to FIG. 3, a top isometric view of capped pipe 200 is shown. Access portal 232 can be seen on the top of maintenance enclosure 204. Access portal 232 allows access to inlet 208, outlet 212 and maintenance components.

Figure 4:
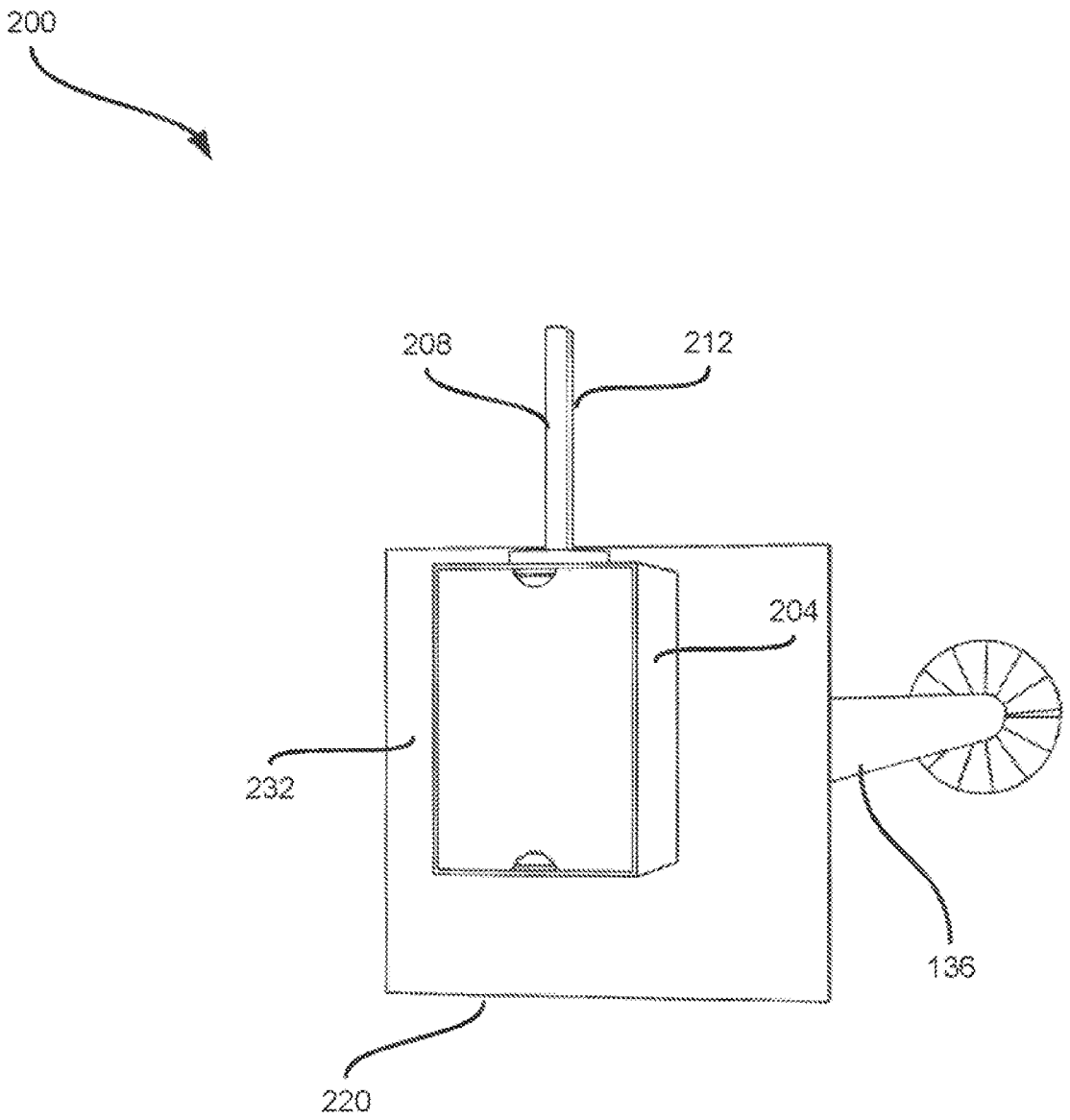
FIG. 4 shows a top view of an embodiment of a capped pipe integrated into a steel pile structural foundation element.
Figure 5:
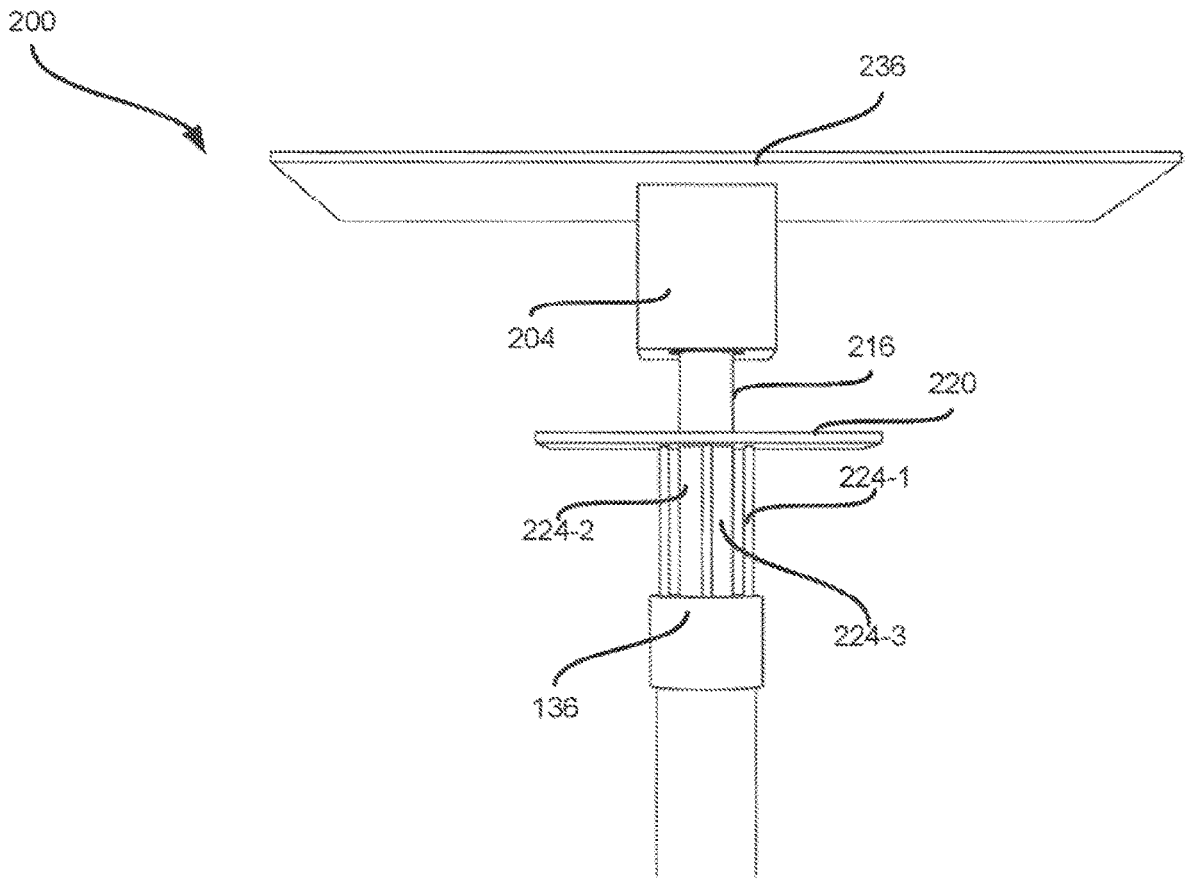
FIG. 5 shows a partial side view of the capped pipe in FIG. 4, installed under flooring.

Referring to FIG. 4, when capped pipe 200 is a structural steel pile or tubular plastic pipe integrated into a structural foundation element, it can be seen from the top view of capped pipe 200 that the access portal 232 may be accessible through the flooring of the structure that capped pipe 200 is installed in. Capped pipe 200 is configured to be installed flush with the flooring. FIG. 5 shows capped pipe 200 installed under flooring 236.

Figure 6:
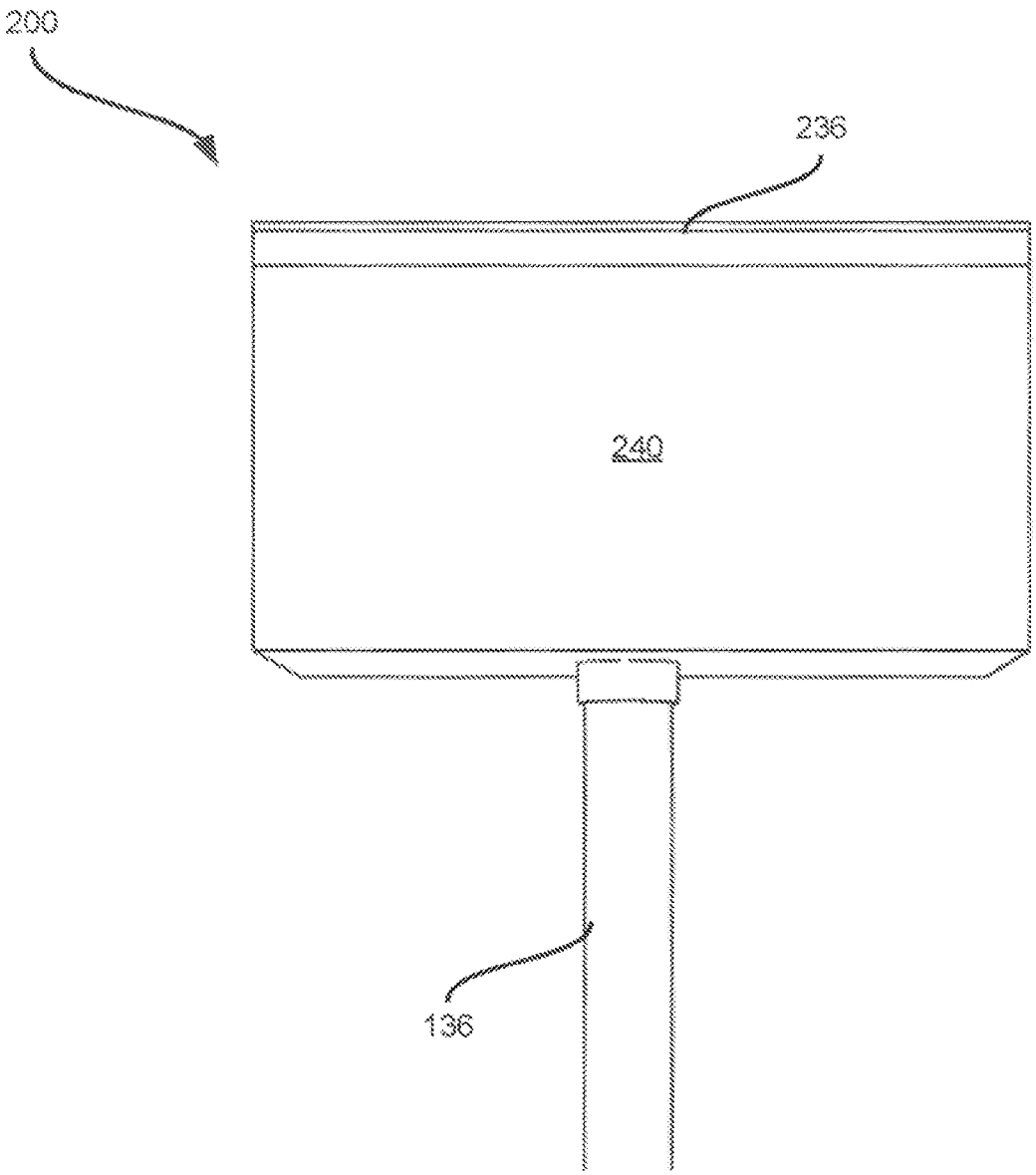
FIG. 6 shows a maintenance enclosure of the capped pipe in poured concrete to form a foundation slab, according to an embodiment.

FIG. 6 shows maintenance enclosure 204 encased in poured concrete to form a foundation slab 240 of the structure that capped pipe 200 is attached to when capped pipe 200 is a structural steel pile or tubular plastic pipe integrated into a structural foundation element. When capped pipe 200 is used solely used as an in-ground heat exchanger directly inserted into the ground it is apparent that the exterior of maintenance enclosure 204 is encased within the ground.

Figure 7:
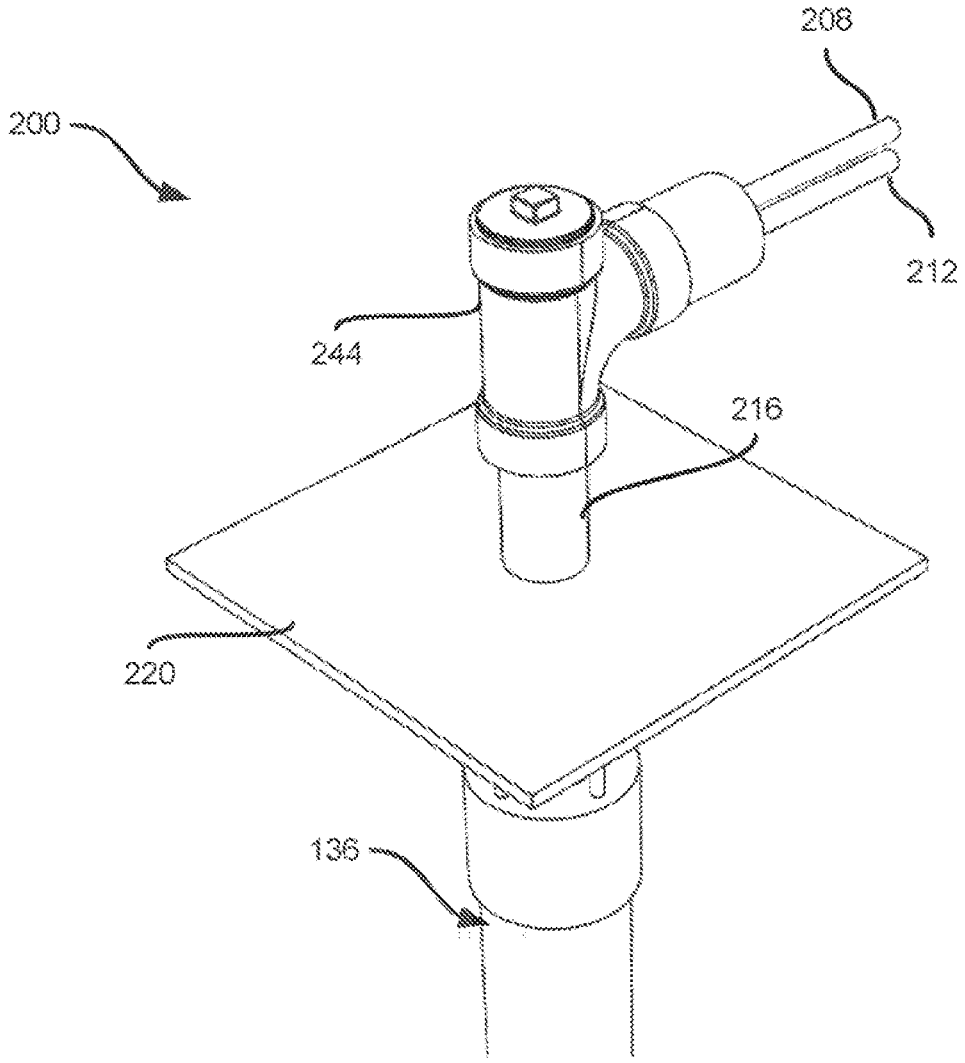
FIG. 7 shows the interior of a maintenance enclosure of the capped pipe in FIGS. 2 to 6.

FIG. 7 shows the interior of maintenance enclosure 204 comprising cleanout pipe 244, surrounding inlet 208 and outlet 212 for added protection of the pipes, which can be accessed with a cleanout plug to allow for regular maintenance of capped pipe 200. The interior of cleanout pipe 244 includes insulation to protect the interior components from condensation. Cleanout pipe 244 may be a PVC pipe, or any other plastic pipe as will be apparent to those skilled in the art.

It is known that building heating and cooling load profiles constantly vary because of numerous factors including seasonal variations, diurnal variations (night/day), weather patterns (i.e. wind, clouds, precipitation), and occupant activities in the building. HVAC systems are designed to meet the peak heating/cooling loads, meaning the rest of the time the system will operate at partial load. By using pipe arrays 128, if system 100 is designed to meet the peak loads, then during times of part load, the energy stored in the working fluid contained within the pipes can be used beneficially through active control to directly influence the supply temperatures provided to heat pump 104 to provide more efficient operation. As such, efficiency (e.g., the coefficient of performance "COP") increases in heating operation as the entering water temperature (EWT) to heat pump 104 increases, and increases in cooling operation as the entering water temperature (EWT) to heat pump 104 decreases.

Figure 8:
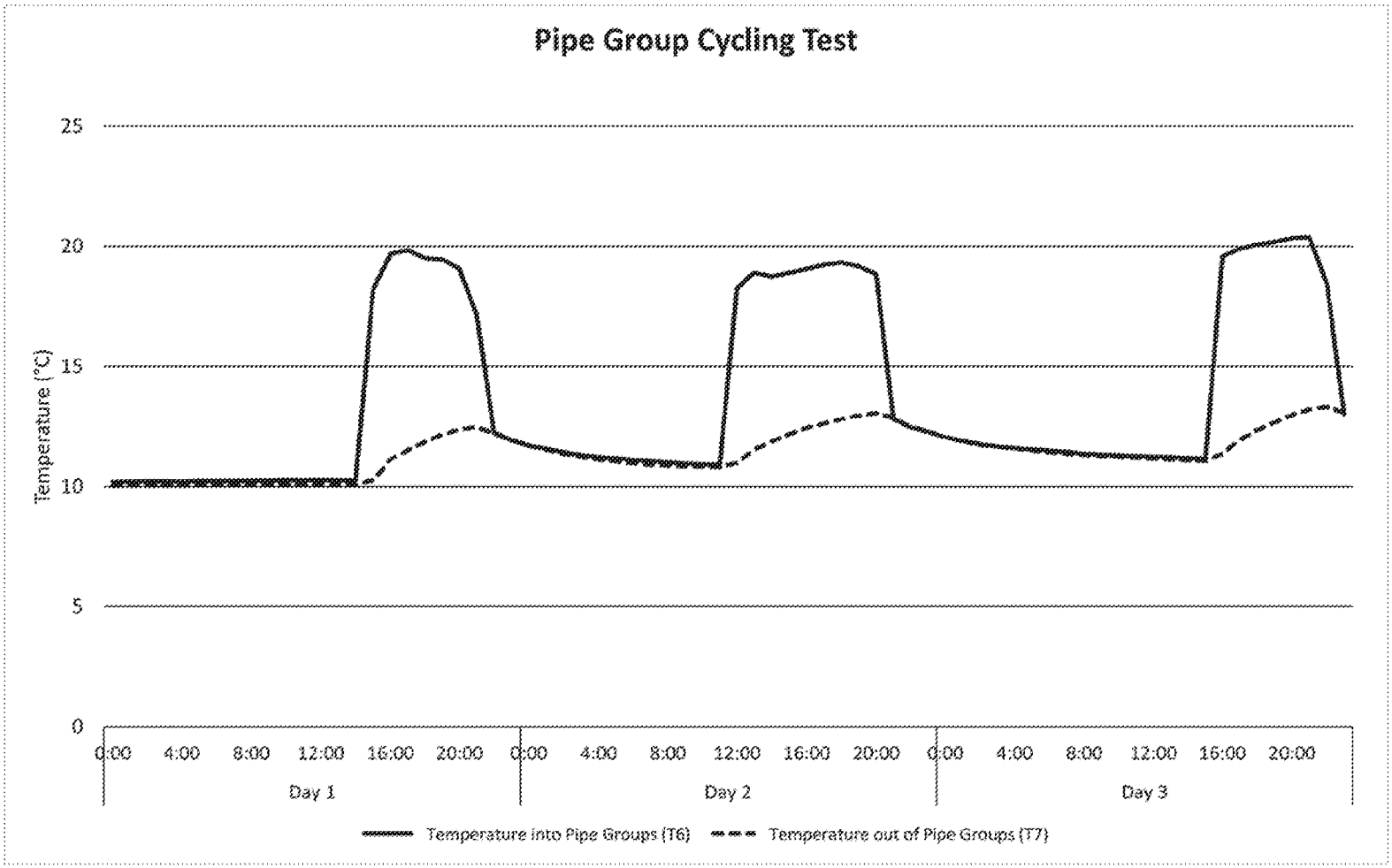
FIG. 8 is a graph showing fluid temperature going into the capped pipes of FIGS. 2 to 6 and the temperature of the fluid coming out of the tubular pipes into a heat exchanger.

By segmenting a system such as system 100 into primary and secondary arrays, each segment is able to "turn off" when it is not needed. If there exists a temperature difference between the working fluid contained within the pipes of turned off segments and the ground, heat naturally moves between the two from higher temperature to lower temperature until there is no longer a temperature difference. In cooling operation, the heat that has accumulated during operation within the working fluid contained in the pipes naturally dissipates into the ground, and in heating operation, heat in the warmer ground naturally moves to the colder working fluid contained in the pipes. As this heat transfer occurs, the working fluid temperature trends toward the desired temperatures. As such, in cooling operation the working fluid gets cooler and in heating operation the working fluid gets warmer. Thus, once a pipe array segment is thereafter turned on, the fluid supply temperature to heat pump 104 will be at a temperature for greater efficient operation, as depicted in FIG. 8 wherein the solid line shows the temperature going into the pipe array and the dashed line shows the temperature of the fluid coming out of the pipe array and into the heat exchanger. As can be seen, the temperature of the fluid coming out of the pipe arrays increases when the cooling load is applied. Once the pipe arrays are turned off, the natural dissipation of the heat is observed by the declining temperature of the flow coming out of the pipe arrays. When the cycle is started again and the cooling load is once again applied, the working fluid is at a more favourable temperature (lower) than if the pipe array had been consistently in-use.

Figure 9:
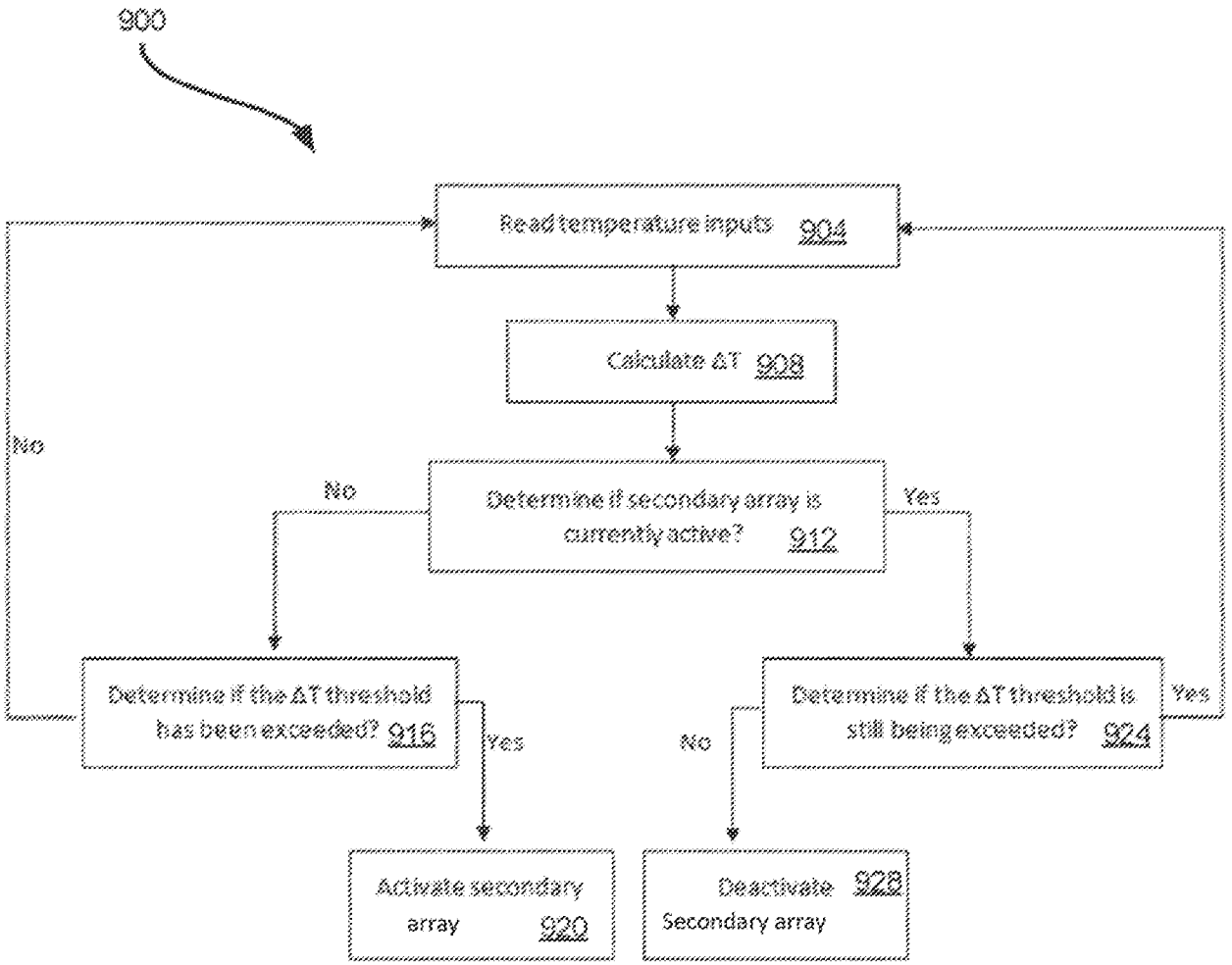
FIG. 9 is a flowchart depicting a control method for optimized operation of a system for in-ground heat exchange using capped, according to an embodiment.

FIG. 9 is a flowchart depicting a control method 900, for optimized operation of the system. This description will reference the specific arrangement of the system as described in FIG. 1, according to the nomenclature of TABLE 1.

TABLE I

| Component Name for Algorithm | Reference in FIG. 1 |
|---|---|
| Primary Array | Conventional Loop |
| Secondary Array | Pipe Group 1 and Pipe Group 2 |
| Primary Array Supply Temperature | T4 Sensor |
| Secondary Array Supply Temperature | T6 Sensor |
| Primary Control Valve | Valve V1 |
| Secondary Control Valves | Valves V2 and V3 |

Method 900 may be described as follows. At block 904, The "Primary Array Supply Temperature" and the "Secondary Array Supply Temperature" are read by the temperature sensors 121 at a determined time step. This can occur at any desired time step; however, for example a time step of no greater than one hour.

At block 908, the difference between the "Primary Array Supply Temperature" and the "Secondary Array Supply Temperature" is calculated. This temperature difference is used to determine the activation and deactivation of the "Secondary Array". The specific temperature difference threshold for activation/deactivation will be determined for each specific system installation. The threshold will depend on factors such as the building heating and cooling load profile, the ambient ground temperature profile, and the type and configuration of the "Secondary Array". In further detail, the amount of potential thermal energy that can be transferred from the "Secondary Array" is determined by the temperature difference between the "Primary Array Supply Temperature" and the "Secondary Array Supply Temperature" and the volume of fluid in the "Secondary Array". The greater the volume of "Secondary Array" fluid and the greater the temperature difference, the greater amount of stored potential thermal energy exists that can be transferred. Therefore the size of the tubular pipes directly impacts this characteristic of each system.

At block 912, the control system determines if the "Secondary Array" is currently active or not. This can be accomplished in system 100 by determining the position of the "Primary Control Valve". If the "Secondary Array" is not active (i.e., at a "no" determination at block 912), then the system is running on the "Primary Array" and the "Secondary Array" is not active, and as such, the pipe array is either not needed or is recharging by passively coming to equilibrium temperature with the ground.

Block 916 determines if the ΔT (temperature difference) threshold has been exceeded or not. If the ΔT threshold has not been exceeded, then the system will continue to operate using only the "Primary Array" and the algorithm returns to block 904 for the next time step.

At block 920, the "Secondary Array" is activated upon a "yes" determination at block 916, to begin transferring thermal energy to/from the "Primary Array" to/from the "Secondary Array". This is accomplished in system 100 by modulating the "Primary Control Valve". When heat pump 104 is in heating mode, the "Secondary Array" transfers heat to the "Primary Array". When heat pump 104 is in cooling mode, the "Primary Array" transfers heat to the "Secondary Array".

If the "Secondary Array" is active (i.e., at a "yes" determination at block 912), then the pipe array 108 is already in use and exchanging thermal energy with the "Primary Array".

Block 924 determines whether or not the ΔT threshold is still being exceeded. If the ΔT threshold is still being exceeded, then the system will continue using the "Secondary Array" and the algorithm returns to block 904 for the next time step. If the "Secondary Array" is already active but the ΔT threshold is no longer exceeded; then, at block 928, the "Secondary Array" is deactivated to stop the transfer of thermal energy to/from the "Primary Array" to allow the fluid in the pipe array 108 to recharge with the ground.

To accurately express the efficiency and performance of system 100, and in specific the efficiency and performance of capped pipes 200, heating and cooling tests were undertaken as described herein.

Figure 10A:
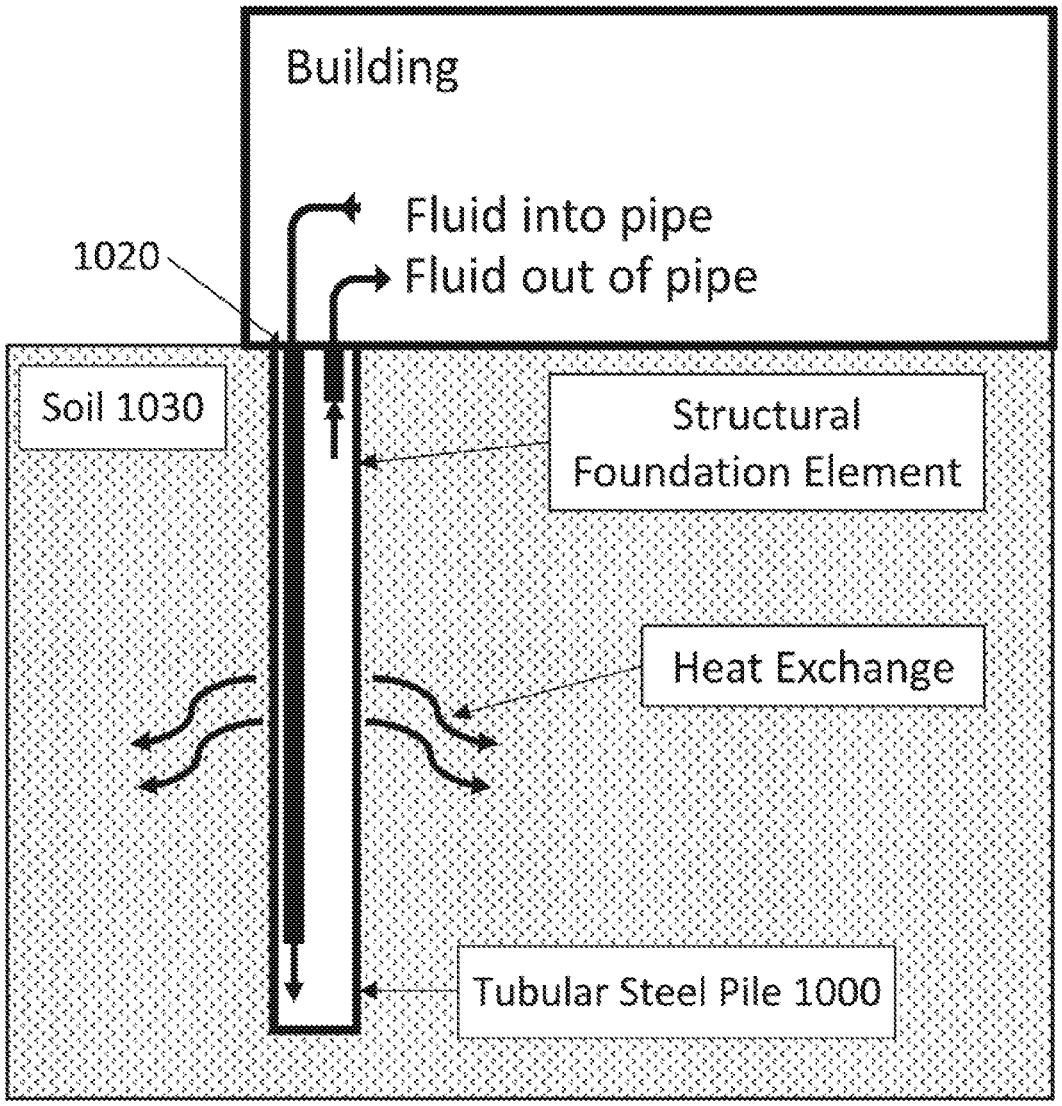
FIG. 10A shows a system for in-ground heat exchange used in a configuration where steel piles are present as foundation elements in a structure such as a building, according to an embodiment.
Figure 10B:
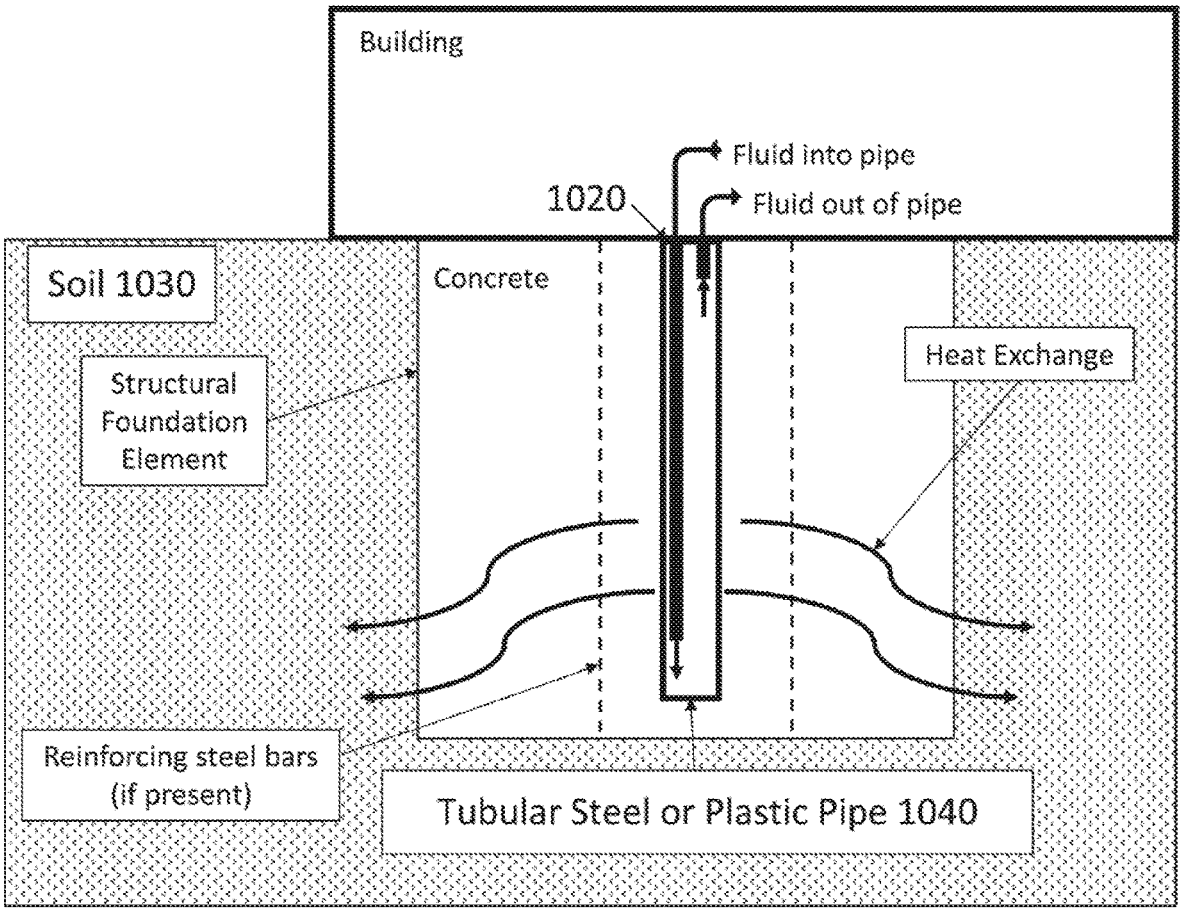
FIG. 10B shows a system for in-ground heat exchange used where structural foundation elements are present in place of structural steel piles present, according to an embodiment.

When steel piles are present as foundation elements in a structure such as a building, arrays of tubular steel piles can be used in the configuration of capped pipes 200, such as helical steel pile 1000 configured as a welded helix having capped tip 1020, as shown in FIG. 10A. The capped tip configuration allows for circulation of working fluid within the interior of the steel pile 1000 to enable the exchange of heat with the soil 1030, as well as access into the interior of the steel piles for regular maintenance. In this way, tubular steel piles 1000 can be used simultaneously as structural foundation elements as well as in-ground heat exchangers.

Where other structural foundation elements are present in place of structural steel piles, such as concrete, as shown in FIG. 10B, arrays of tubular steel or plastic pipes 1040 of similar geometry as the steel piles 1000, can be integrated into the other structural foundation elements. The capped tubular steel or plastic pipes 1040 allow for the circulation of working fluid within the interior thereof when housed within the structural foundation element, to enable the exchange of heat with the soil 1030 through the structural foundation element, as well as access to the interior of the tubular plastic pipes for regular maintenance.

Figure 10C:
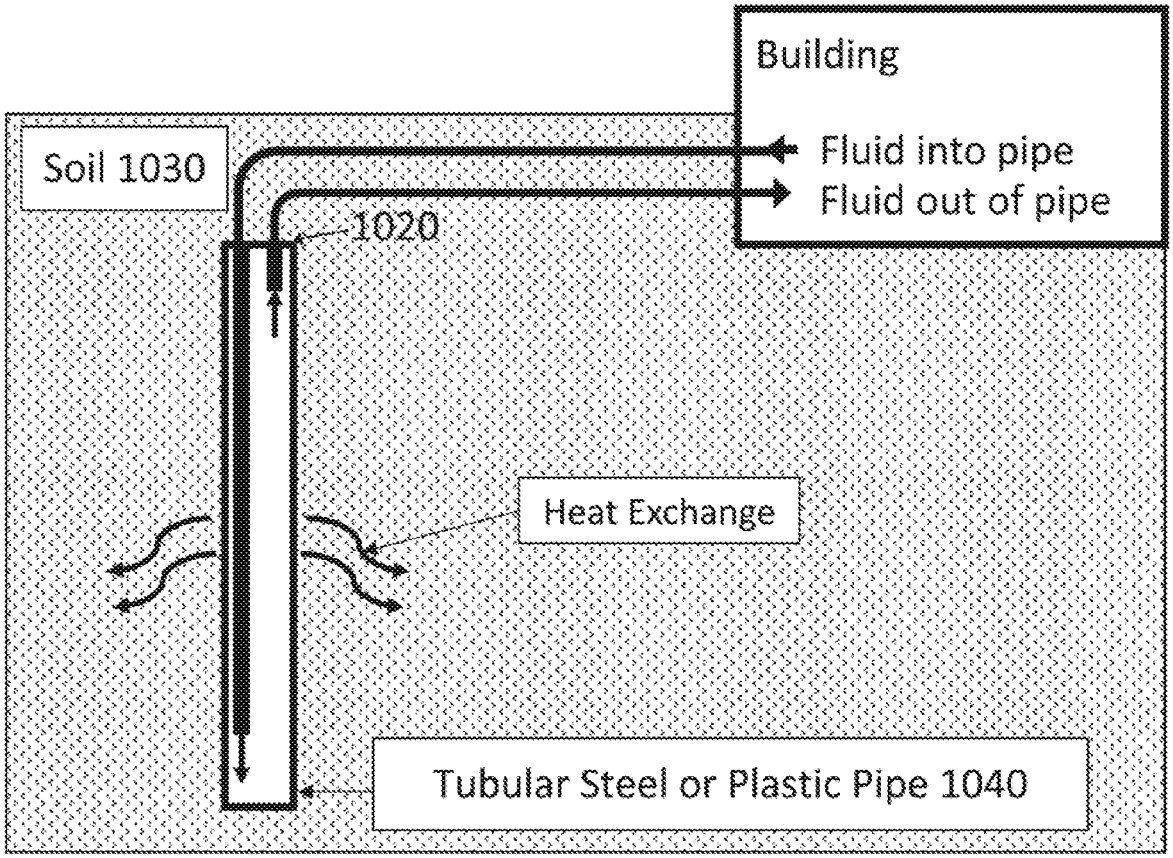
FIG. 10C shows a system for in-ground heat exchange where arrays of tubular steel or plastic pipes are installed directly into the soil solely for the purpose of in-ground heat exchange, according to an embodiment.

As shown in FIG. 10C, arrays of tubular steel or plastic pipes 1040 can also be installed as directly into the soil 1030 solely for the purpose of in-ground heat exchange, where the structural foundation elements of a building may not provide sufficient thermal capacity to meet the full heating and cooling requirements of a building. The embodiments shown in FIGS. 10A, 10B and 10C can be installed at depths of about 6 to 30 meters, which is generally a much shallower depth than conventional borehole loops.

Persons of skill in the art may conceive of other embodiments and variations. The scope of the claims should not be limited by the embodiments set forth in the above examples but should be given the broadest interpretation consistent with the description as a whole.

The invention claimed is:

1. A system for in ground heat exchange, the system comprising:

a primary in ground array and at least one secondary in ground array, each primary and secondary in ground array comprising:

a plurality of capped pipes;

at least one temperature sensor; and at least one flow rate sensor;

a plurality of flow rate valves connected to the primary in ground array and at least one secondary in ground array, the flow rate valves configured to facilitate flow of a liquid through the system;

at least one circulating pump attached to the flow rate valves forming a closed loop system for modulating the flow rate of the system;

at least one heat exchanger attached to the pump and flow rate valves to transfer heat between the primary in ground array and the at least one secondary in ground array; and a heat pump;

wherein the system is configured to provide heating and cooling to a building by calculating temperature differences between the primary in ground array and the at least one secondary in ground array and, based on the calculated temperature differences, either activating or deactivating the at least one secondary in ground array for operating the heat pump in a heating mode wherein the at least one secondary in ground array transfers heat to the primary in ground array, or in a cooling mode wherein the primary in ground array transfers heat to the at least one secondary in ground array via the plurality of flow rate valves, the at least one circulating pump, and the at least one heat exchanger, thereby enabling fluid within the at least one secondary in ground array to naturally absorb heat from the ground during heating mode operation of the heat pump or dissipate heat into the ground during cooling mode operation of the heat pump while the at least one secondary in ground array is deactivated and flow of the fluid through the at least one secondary in ground array is stopped, such that the fluid passively comes to equilibrium temperature with the ground for greater efficient operation of the heat pump on subsequent activation of the at least one secondary in ground array, and wherein when the calculated temperature difference exceeds a threshold, the at least one secondary in ground array is activated, and when the calculated temperature difference no longer exceeds the threshold, the at least one secondary in ground array is deactivated.

2. The system of claim 1, wherein the capped pipes each include a tubular pipe and a capped tip.

3. The system of claim 2, wherein the tubular pipe is configured to receive heat exchange fluid from an inlet pipe and discharge the heat exchange fluid to an outlet pipe.

4. The system of claim 3, wherein the capped tip comprises a maintenance enclosure surrounding the inlet pipe and outlet pipe.

5. The system of claim 2, wherein the tubular pipe is fabricated from steel and embedded in soil to structurally support the building.

6. The system of claim 2, wherein the tubular pipe is fabricated from plastic for integration into at least one structural foundation element supporting the building.

7. The system of claim 2, wherein the tubular pipe is fabricated from one of either steel or plastic and embedded in soil for in-ground heat exchange.

8. The system of claim 4, wherein the maintenance enclosure includes a portal for access to at least one maintenance component.

9. The system of claim 8, wherein the maintenance component is a cleanout.

10. The system of claim 4, further including a pipe enclosure connected to the maintenance enclosure for enclosing the inlet pipe and outlet pipe.

11. The system of claim 10, wherein the pipe enclosure is fabricated from plastic.

12. The system of claim 10, further including a load bearing plate for supporting the pipe enclosure and transmitting structural load down to the tubular pipe.

13. The system of claim 12, wherein the plate is fabricated from steel.

14. The system of claim 13, further comprising at least one rod welded to the plate to transfer the structural load from the plate to the tubular pipe.

15. A method for in ground heat exchange, the method comprising:

segmenting a primary in ground array from at least one secondary in ground array;

collecting temperature inputs through temperature sensors on the primary in ground array and at least one secondary in ground array;

calculating a temperature difference in the working fluid between the primary in ground array and the at least one secondary in ground array;

determining whether a temperature difference threshold has been exceeded, and activating the at least one secondary in ground array to transfer heat between the primary in ground array and at least one secondary in ground array upon determination that the temperature difference threshold has been exceeded, and deactivating the at least one secondary in ground array upon determination that the temperature difference threshold is no longer exceeded, thereby enabling the working fluid within the at least one secondary in ground array to naturally absorb heat from the ground during heating operation or dissipate heat into the ground during cooling operation, thereby enabling the working fluid to passively come to equilibrium temperature with the ground for greater efficient operation on subsequent activation of the at least one secondary in ground array.

* * * * *